US005406175A

United States Patent [19]

Speaker

[11] Patent Number: 5,406,175

[45] Date of Patent: Apr. 11, 1995

[54] LEAD BALLAST CIRCUIT WITH POWER REGULATION FOR A GAS DISCHARGE LAMP

[75] Inventor: Lawrence W. Speaker, Hendersonville, N.C.

[73] Assignee: General Electric Company, Schenectady, N.Y.

[21] Appl. No.: 140,996

[22] Filed: Oct. 26, 1993

[51] Int. Cl.[6] ..... H05B 41/16

[52] U.S. Cl. ..... 315/276; 315/278; 315/282; 315/247; 315/244; 315/DIG. 5

[58] Field of Search ..... 315/276, 278, 282, 247, 315/224, 244, DIG. 5

[56] References Cited

U.S. PATENT DOCUMENTS

| | | | |
|---|---|---|---|
| 3,678,371 | 7/1972 | Nuckolls | 315/278 X |
| 3,684,921 | 8/1972 | De Leon | 315/276 |
| 3,772,565 | 11/1973 | Lenz et al. | 315/276 |
| 4,891,562 | 1/1990 | Nuckolls et al. | 315/276 X |
| 5,049,789 | 9/1991 | Kumar et al. | 315/DIG. 5 X |

*Primary Examiner*—Robert J. Pascal
*Assistant Examiner*—Haissa Philogene
*Attorney, Agent, or Firm*—George E. Hawranko; Stanley C. Corwin

[57] ABSTRACT

A lead ballast circuit with power regulation for a gas discharge lamp includes an input pair of conductors for receiving an a.c. supply voltage, the magnitude of which voltage fluctuates within a known range. Further included is an output pair of conductors for supplying a driving voltage to the lamp. A lead inductor having a magnetic core and a lead capacitance serially connected to the lead inductor between an input, and an output, conductor are included. The inductive impedance of the lead inductor is less than the capacitive impedance of the lead capacitance whereby the aggregate impedance of the serially connected inductor and capacitance is capacitive rather than inductive. The lead ballast circuit also includes a power factor-correcting inductor connected across the input conductor pair, and having a magnetic core that shares a leg in common with the magnetic core of the lead inductor. The magnetic cores of the lead and power factor-correcting inductors are constructed so that magnetic flux in the common leg increases in saturation as the a.c. supply voltage increases within the mentioned fluctuation range, hence reducing the inductive impedance of the lead inductor and consequently increasing the mentioned aggregate impedance, whereby, as the a.c. supply voltage increases in the fluctuation range, an increasing amount of such voltage appears across the increasing aggregate impedance so as to maintain the voltage and hence power of the lamp within a regulated range.

7 Claims, 3 Drawing Sheets

LEAD BALLAST CIRCUIT WITH POWER REGULATION FOR A GAS DISCHARGE LAMP

FIELD OF THE INVENTION

The present invention relates to circuits for receiving an a.c. supply voltage and providing a conditioned voltage for driving a gas discharge lamp.

BACKGROUND OF THE INVENTION

Gas discharge lamps such as metal halide or fluorescent lamps are typically powered from a source of a.c. power. The a.c. voltage, however, is typically first conditioned by a so-called ballast circuit that provides a suitable driving voltage for the lamp to achieve at least a minimum level of lamp performance.

A typical prior art ballast circuit is known as a "lead" ballast circuit, since it provides current to a lamp at a phase angle in advance of, or leading, the voltage supplied to the lamp. Such ballast circuits typically use a capacitor and an inductor serially connected to the lamp. The capacitive impedance of the capacitor significantly exceeds the inductive impedance of the inductor. The aggregate impedance of the serially connected capacitor and inductor is thus capacitive, which causes the current supplied to the lamp to be leading.

It is desirable, however, that the current drawn from the a.c. source have a phase angle close to that of the voltage supplied by the source. This is necessary to achieve a good power factor for the ballast circuit, which power factor is maximized when the current and voltage from the a.c. source are exactly in phase. To address this problem, a power factor-correcting inductor can be connected across the a.c. supply of a lead ballast circuit. Such inductor will draw inductive, or lagging, current from the a.c. source. The aggregate current drawn from the source, which includes the leading current from the mentioned capacitor and inductor of the lead ballast circuit becomes less leading, i.e. more in phase with the voltage supplied by the a.c. source. A high power factor is thus obtained.

The foregoing solution of using a power factor-correcting inductor in a lead ballast circuit, however, fails to remedy a poor level of regulation of power provided to the lamp. Typically, a 10 percent fluctuation in the a.c. supply voltage results in about a 10 percent fluctuation in lamp power. Such fluctuation in lamp power frequently manifests in annoying changes in the light-output level of a lamp. It would, therefore, be desirable to provide a lead ballast circuit for a gas discharge lamp that attains regulation of lamp power to a narrower range, such as 5 percent, for instance.

OBJECTS AND SUMMARY OF THE INVENTION

It is, accordingly, an object of the present invention to provide a lead ballast circuit with power regulation for a gas discharge lamp wherein lamp power is regulated to be within a narrow range.

In accordance with the invention, a lead ballast circuit with power regulation for a gas discharge lamp is provided. The lead ballast circuit includes an input pair of conductors for receiving an a.c. supply voltage, the magnitude of which voltage fluctuates within a known range; and an output pair of conductors for supplying a driving voltage to the lamp. The circuit further includes a lead inductor having a magnetic core, and a lead capacitance serially connected to the lead inductor between an input, and an output, conductor. The inductive impedance of the lead inductor is less than the capacitive impedance of the lead capacitance whereby the aggregate impedance of the serially connected inductor and capacitance is capacitive rather than inductive. The lead ballast circuit also includes a power factor-correcting inductor which is connected across the input conductor pair, and which has a magnetic core sharing a leg in common with the magnetic core of the lead inductor. The magnetic cores of the lead and power factor-correcting inductors are constructed so that magnetic flux in the common leg increases in saturation as the a.c. supply voltage increases within the mentioned fluctuation range, hence reducing the inductive impedance of the lead inductor and consequently increasing the mentioned aggregate impedance, whereby, as the a.c. supply voltage increases in the fluctuation range, an increasing amount of such voltage appears across the aggregate impedance so as to maintain the voltage and hence power of the lamp within a regulated range.

BRIEF DESCRIPTION OF THE DRAWING

The foregoing objects and further advantages and features of the invention will become apparent from the following specification taken in conjunction with the appended drawing, in which.

DETAILED DESCRIPTION OF THE PREFERRED EMBODIMENTS

Figure 1:
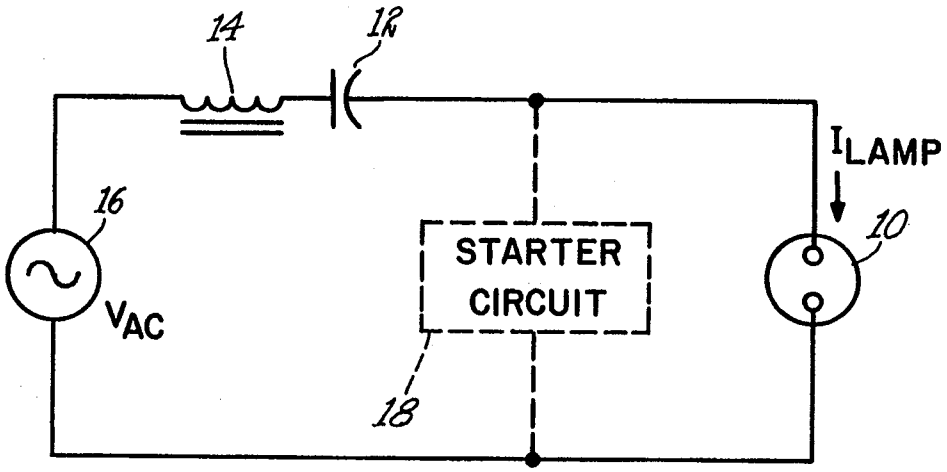
Fig. 1 (PRIOR ART)
FIG. 1 is a schematic diagram of a typical lead ballast circuit and gas discharge lamp according to the prior art.

FIG. 1 is a schematic diagram of a typical prior art lead ballast circuit for a gas discharge lamp 10, which may, for instance, comprise a high pressure metal halide lamp. The circuit receives a.c. voltage $V_{AC}$ from an a.c. source 16. To condition voltage supplied to the lamp, the circuit includes a lead capacitor 12 in series with lamp 10, and a lead inductor 14 in series with lead capacitor 12. A starter circuit 18, shown in phantom, may be provided to facilitate starting of lamp 10; for instance, where lamp 10 is a metal halide lamp, a typical starter circuit 18 provides a pulse of high voltage to initiate starting of the lamp. The reason why the circuit of FIG. 1 is known as a "lead" ballast circuit is now explained with respect to FIG. 2.

Figure 2:
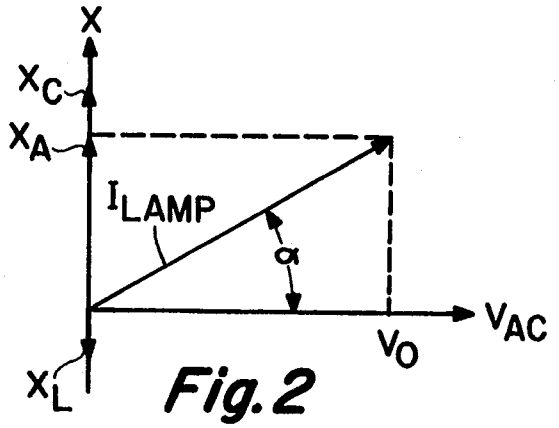
FIG. 2 is a vector diagram for determining lamp current as a function of a.c. input voltage and the impedances of a capacitor and inductor such as used in the circuit of FIG. 1.

FIG. 2 is a vector diagram plotting the reactive impedance, X, of lead capacitor 12 and lead inductor 14 versus the a.c. supply voltage $V_{AC}$. The capacitive impedance of lead capacitor 12 is shown as $X_c$; the inductive impedance of lead inductor 14 is shown as negatively directed $X_L$. The aggregate impedance $X_A$ of the lead capacitor and inductor, according to FIG. 2, equals the vector addition of the capacitive impedance $X_c$ and the negatively directed inductive impedance $X_L$. For a given value of a.c. input voltage $V_{AC}$, lamp current $I_{LAMP}$ can be represented as shown in FIG. 2 at the specified voltage $V_O$. In the convention of the FIG. 2 vector diagram, the phase of the lamp current $I_{LAMP}$ is shown as leading the phase of the a.c. input voltage $V_{AC}$ by an angle $\alpha$; accordingly, the circuit of FIG. 1 is known as a "leading" circuit.

The leading current provided by the prior art lead ballast circuit of FIG. I conditions the voltage driving the lamp to achieve a minimum level of lamp operation. However, in the circuit of FIG. 1, the current provided by the a.c. supply 16 is significantly out of phase (i.e., leading) the a.c. voltage $V_{AC}$; this results in a low power factor for the FIG. 1 circuit. This can be remedied by providing, in addition to the lamp current drawn from a.c. supply 16, an inductive current also drawn from the supply. Such a modification of the FIG. 1 circuit is shown in the circuit of FIG. 3, wherein reference numerals sharing the same second digit (e.g. 12, 32) refer to like parts.

Figure 3:
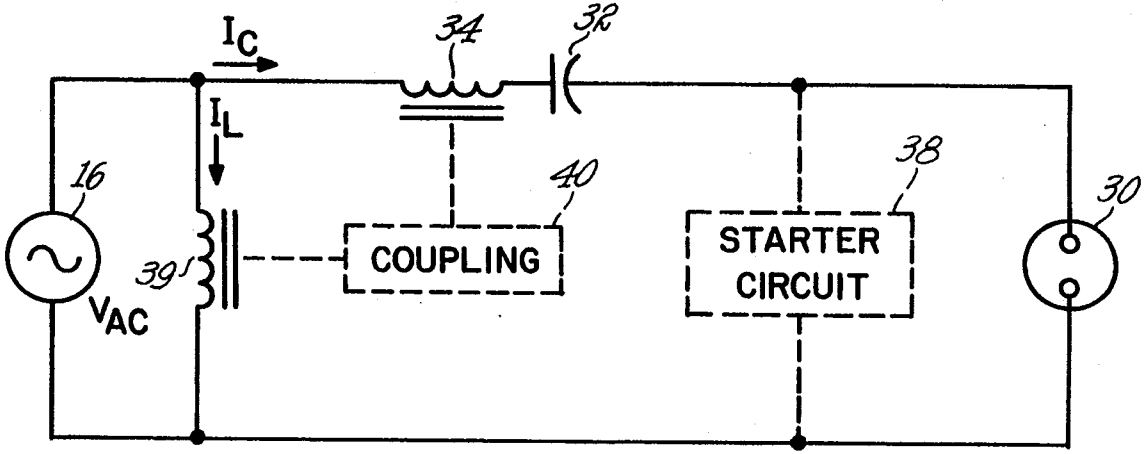
FIG. 3 is a schematic diagram of a lead ballast circuit and lamp, such as shown in FIG. 1, together with a power factor-correcting inductor placed across an a.c. supply voltage.

In FIG. 3, a power factor-correcting inductor 39 has been provided to draw an inductive current $I_L$ from a.c. supply 16. Power factor-correcting inductors (such as 39) are known per se, and are typically embodied as an auto-transformer that conveniently provides multiple output voltages on different taps. Typically, a power factor-correcting inductor will draw sufficient inductive current from an a.c. supply so as to result in a net current draw from the a.c. supply that is slightly capacitive, or slightly leading the a.c. voltage $V_{AC}$; this results in a good power factor.

Ignoring for the moment the presence of a coupling 40 between lead and power factor-correcting inductors 34 and 39, the mere addition of a power factor-correcting inductor to a lead ballast circuit, while improving power factor, fails to remedy poor regulation of lamp power resulting from fluctuations in the a.c. supply voltage $V_{AC}$. For instance, with a 400-watt metal halide lamp 30, a 10 percent fluctuation in the a.c. supply voltage (e.g. an increase) results in a roughly corresponding fluctuation (e.g. increase) in voltage, and hence power, supplied to the lamp. The higher the a.c. supply voltage is in relation to voltage across the lamp, the closer this relation holds.

Figures 4A, 4B:
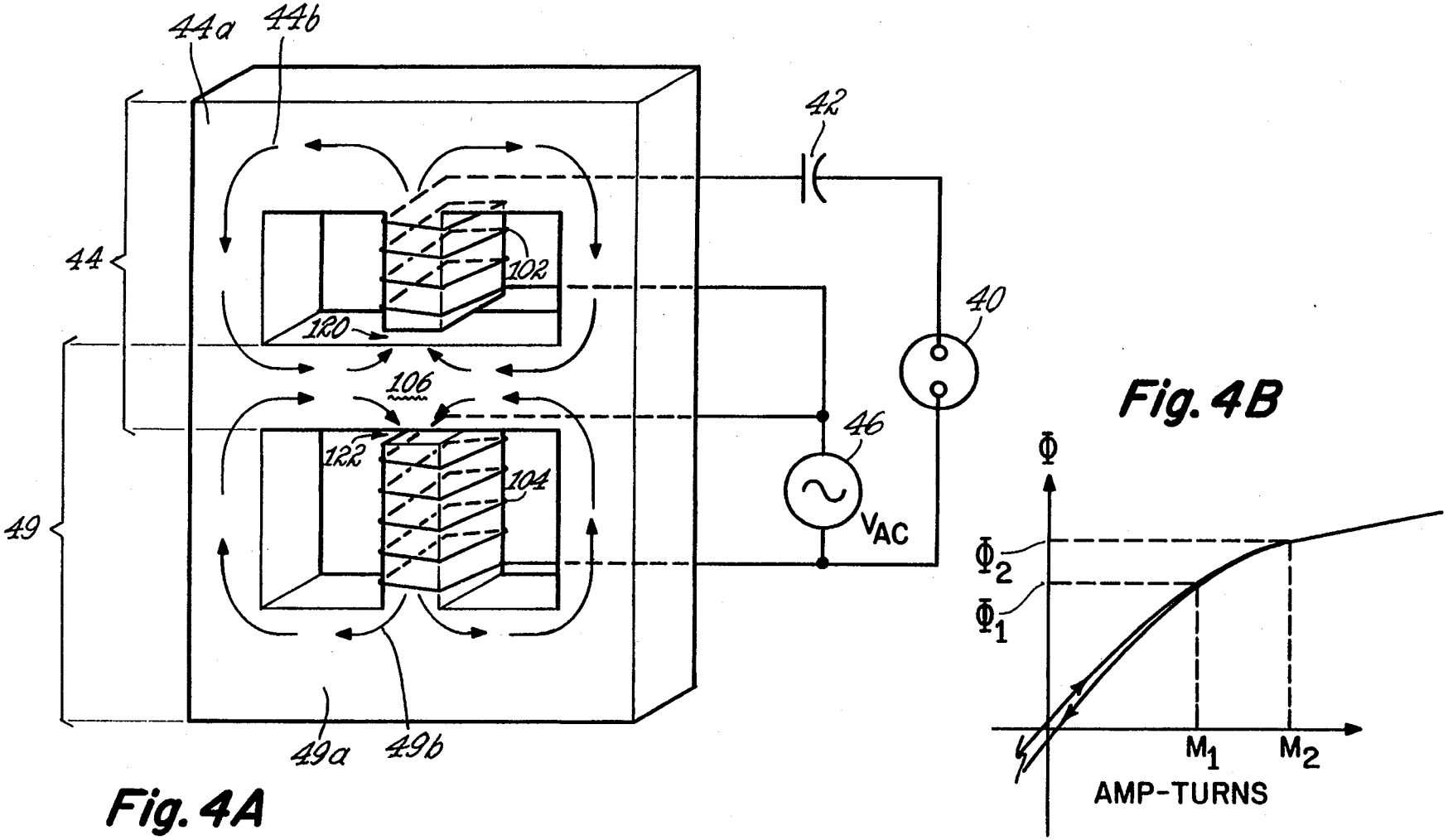
FIG. 4A shows one embodiment of the circuit of FIG. 3 with a lead inductor and a power factor-correcting inductor illustrated as having magnetic cores that are joined together by a common leg.
FIG. 4B shows a quadrant of a magnetic flux curve for the common leg of the joined magnetic cores of the lead and power factor-correcting inductors of FIG. 4A.
Figure 4C:
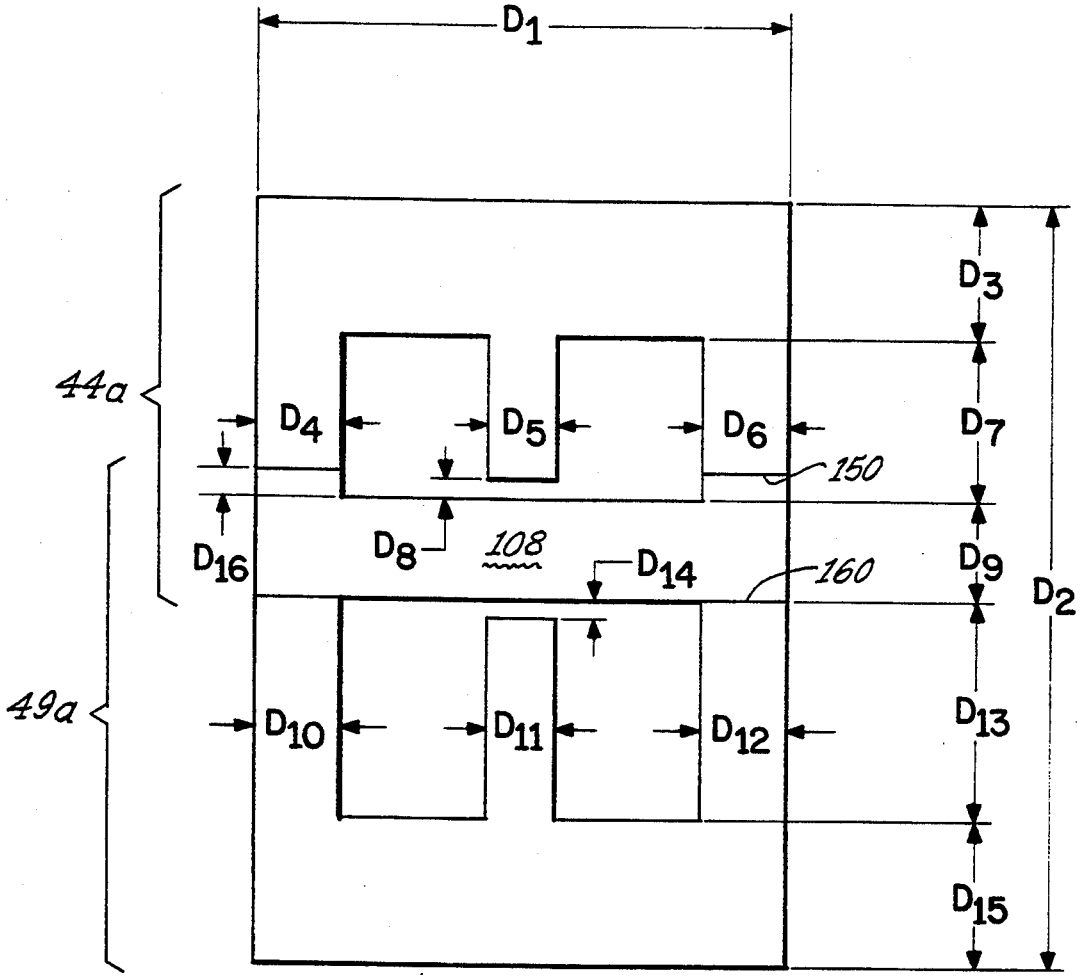
FIG. 4C is a front elevation view of the joined magnetic cores of the lead and power factor-correcting inductors of FIG. 4A.

To achieve a higher level of regulation of lamp power, coupling 40 is provided between lead inductor 34 and power factor-correcting inductor 39. FIGS. 4A–4C are directed towards coupling 40. Using coupling 40, lamp power regulation to within 5 percent has been achieved where the a.c. supply voltage fluctuates between plus and minus 10 percent.

In FIG. 4A, reference numerals sharing the same second digit (e.g. 40, 30) as reference numerals in FIG. 3 refer to like parts. FIG. 4A shows one embodiment of the circuit of FIG. 3 with a lead inductor 44 and a power factor-correcting inductor 49 illustrated as having respective magnetic cores **44*a* and 49*a*. Magnetic cores 44*a* and 49*a* are formed from magnetic material such as M36 steel. Additionally included in lead inductor 44 is a coil 102, and similarly included in power factor-correcting inductor 49 is a coil 104. As in FIG. 3, the circuit of FIG. 4A includes a lamp 50, a lead capacitor 42, and an a.c. supply 46. Starter circuit 38 of FIG. 3, however, has been omitted from FIG. 4A for clarity, although it typically would be used in the FIG. 4A** circuit.

Significantly, magnetic cores **44*a* and 49*a* of lead and power factor-correcting inductors 44 and 49 are joined together by a common leg 106. In overview, common leg 106 is operated at varying degrees of saturation of the magnetic flux it contains to achieve regulation of power in lamp 50. The respective magnetic fluxes induced by coils 102 and 104, shown at 44*b* and 49*b* cumulatively produce the mentioned saturation of common leg 106, although they are somewhat out of phase with each other. On the other hand, any transformer coupling between lead inductor 44 and power factor-correcting inductor 49**, i.e., where current in one inductor induces current in the other inductor, is preferably minimized.

As the a.c. supply voltage $V_{AC}$ increases, the magnetic flux induced by power factor-correcting coil 104 drives common leg 106 further into saturation. This affects lead inductor 44 by reducing its inductive impedance; consequently, as readily understood from reference to the vector diagram of FIG. 2, the aggregate impedance $X_A$ of capacitor 42 and lead inductor 44 actually increases in value, since the subtracted inductive impedance value $X_L$ is reduced. Referring to FIG. 3, an increase in a.c. supply voltage $V_{AC}$ results in a major part of such voltage increase appearing across lead capacitor 32 and lead inductor 34 whose aggregate impedance $X_A$, as mentioned, has increased. The lamp voltage tends to remain largely unchanged, resulting in lamp power similarly remaining largely unchanged.

To further explain the saturation effect in common leg 106 shown in FIG. 4A, FIG. 4B shows one quadrant of a curve illustrating the magnetic flux in common leg 106, $\Phi$, versus the magnetizing force of amp-turns contributed by both lead inductor 44 and power factor-correcting inductor 49. The slope of the curve in FIG. 4B represents the permeability of common leg 106, which is a measure of the degree to which magnetic flux in the common leg changes in response to the amp-turns in the lead and power factor-correcting inductors. To achieve the desired power regulation, common leg 106 is preferably designed to operate in a region of rapidly changing permeability bounded by a lower flux level $\Phi_1$ and a higher flux level $\Phi_2$. Above and below this flux range $\Phi_1$–$\Phi_2$, the permeability of the common leg 106 is generally linear. Typically, lower flux boundaries $\Phi_1$ is between about 65 and 70 percent of full saturation, and upper flux boundary, between 85 and 90 percent of full saturation. Such lower and upper flux boundaries, however, vary from one magnetic core design to another, but can be readily determined by persons of ordinary skill in the art.

To broaden the range of fluctuation of a.c. supply voltage over which regulation of the lamp power is achieved, magnetic core **44*a* of lead inductor 44 typically has an air gap such as shown at 120, and magnetic core 49a similarly has an air gap 122. Inclusion of air gaps 120 and 122 has the effect, in the flux curve of FIG. 4B**, of reducing the slope of the flux curve (i.e. rotating it clockwise). This increases the range of the magnetizing force of amp-turns, from magnetizing force $M_1$ to magnetizing force $M_2$, over which lamp power regulation is achieved. Magnetizing forces $M_1$ and $M_2$ respectively correspond to flux levels $\Phi_1$ and $\Phi_2$.

Techniques other than using air gaps in magnetic cores 44a and 49a for broadening the dynamic regulation range $M_1$–$M_2$ of the present circuit will readily occur to those skilled in the art.

The following table shows test results obtained while varying a.c. supply voltage $V_{AC}$ plus and minus 10 percent from a nominal value of approximately 277 volts. Of particular interest is that the r.m.s. lamp voltage, and hence lamp watts, only varies within a regulation range of less than 5 percent. The table also shows other desirable data for a lamp ballast circuit, such as ballast efficiency in excess of 87 percent, and a lamp current crest factor (i.e. ratio of peak lamp current to r.m.s. lamp current) of less than 1.7. The units used for voltage and current are volts and amps, respectively.

| Test Results for Varying $V_{AC}$: | −10% | Nominal | +10% |
|---|---|---|---|
| R.m.s. supply voltage $V_{AC}$ | 249.20 | 277.10 | 304.70 |
| R.m.s. supply current | 1.88 | 1.77 | 1.74 |
| Peak supply current | 3.07 | 2.84 | 2.62 |
| Watts drawn from a.c. supply | 458.30 | 485.40 | 511.90 |
| Percent power factor | 97.61 | 98.82 | 96.51 |
| R.m.s. lamp voltage | 135.50 | 134.90 | 135.90 |
| Peak lamp voltage | 196.70 | 200.30 | 208.10 |
| R.m.s. lamp current | 3.22 | 3.41 | 3.53 |
| Peak lamp current | 5.05 | 5.50 | 5.99 |
| Lamp watts | 410.60 | 429.60 | 445.90 |
| Change in lamp watts | 19.00 | 0.00 | 16.30 |
| Percent regulation | 4.42 | 0.00 | 3.79 |
| Percent efficiency | 89.59 | 88.50 | 87.11 |
| Lamp current crest factor | 1.57 | 1.61 | 1.70 |
| Losses (watts) | 47.70 | 55.80 | 66.00 |
| R.m.s. current in the power factor-correcting inductor | 2.04 | 2.56 | 3.15 |

Referring again to FIG. 4A, the test results in the foregoing table were obtained with a 400-watt high pressure metal halide gas discharge lamp 40, a lead capacitor 42 rated at 22 microfarads, and joined magnetic cores 44a and 49a comprising 0.457 mm thick laminations of M36 steel with an aggregate thickness, or depth as viewed in FIG. 4A, of 45.97 mm. Other dimensions of magnetic cores 44a and 49a, referring to dimensions $D_1$ to $D_{15}$ of FIG. 4C, were as follows: Dimension $D_1$=99.69 mm; $D_2$=140.67 mm; $D_3$=14.98 mm; $D_4$=15.04 mm; $D_5$=29.85 mm; $D_6$15.04 mm; $D_7$=40.89 mm; $D_8$=1.78 mm; $D_9$=14.35 mm; $D_{10}$15.04 mm; $D_{11}$=29.85 mm; $D_{12}$=15.04 mm; $D_{13}$=55.07 mm; $D_{14}$=1.91 mm; $D_{15}$=14.98 mm; and $D_{16}$=5.46 mm. Joined magnetic cores 44a and 49a, moreover, had horizontal seams 150 and 160 of about 0.127 mm effective air gap equivalence. The number of turns of lead reactor 44 (FIG. 4A) was 600; and the number of turns of power factor-correcting inductor 49 was 378.

From the foregoing, it will be appreciated that the present invention provides a lead ballast circuit with power regulation for a gas discharge lamp wherein lamp power is regulated to be within a narrow range. The lead ballast circuit, beneficially, can be made with readily available parts.

While the invention has been described with respect to specific embodiments by way of illustration, many modifications and changes will occur to those skilled in the art. It is, therefore, to be understood that the appended claims are intended to cover all such modifications and changes as fall within the true spirit and scope of the invention.

What is claimed is:

1. A lead ballast circuit with power regulation for a gas discharge lamp, comprising:

(a) an input pair of conductors for receiving an a.c. supply voltage, the magnitude of which voltage fluctuates within a known range;

(b) an output pair of conductors for supplying a driving voltage to said lamp;

(c) a lead inductor having a magnetic core and a lead capacitance serially connected to said lead inductor between an input and an output conductor, said lead inductor having associated therewith, an inductive impedance which is less than the capacitive impedance of said lead capacitance whereby the aggregate impedance of said serially connected lead inductor and lead capacitance is capacitive rather than inductive;

(d) a power factor-correcting inductor connected across said input conductor pair, and having a magnetic core that shares a leg in common with said magnetic core of said lead inductor;

(e) said magnetic cores of said lead and power factor-correcting inductors being constructed so that magnetic flux in said common leg increases in saturation as the a.c. supply voltage increases within the mentioned fluctuation range, hence reducing the inductive impedance of said lead inductor and consequently increasing said aggregate impedance, whereby, as the a.c. supply voltage increases in said fluctuation range, an increasing amount of said voltage appears across said aggregate impedance so as to maintain the voltage and hence power of said lamp within a regulated range; and, (f) wherein the respective magnetic cores of said lead and power factor-correcting inductors are so constructed that magnetic flux in said common leg is greater than about 65 percent of saturation when the a.c. supply voltage is at the low end of said fluctuation range and less than about 90 percent of saturation when said voltage is at the high end of said range.

2. The lead ballast circuit of claim 1, wherein said fluctuation range is at least about plus and minus 10 percent from a fixed value.

3. The lead ballast circuit of claim 1, wherein said regulated range of lamp power is less than about 5 percent of total lamp power.

4. The lead ballast circuit of claim 1, wherein the respective magnetic cores of said lead and power factor-correcting inductors each has a respective air gap selected to achieve the mentioned saturation of magnetic flux in said common leg.

5. The lead ballast circuit of claim 1, wherein said gas discharge lamp comprises a high pressure gas discharge lamp.

6. The lead ballast circuit of claim 5, wherein said high pressure gas discharge lamp comprises a high pressure metal halide gas discharge lamp.

7. The lead ballast of claim 1 in combination with said gas discharge lamp.

* * * * *